US008677566B2

(12) United States Patent
Vanini

(10) Patent No.: US 8,677,566 B2
(45) Date of Patent: Mar. 25, 2014

(54) HINGE FOR DOORS OR WINGS

(75) Inventor: Angelo Vanini, Bologna (IT)

(73) Assignee: Nuova Star S.p.A. (IT)

( * ) Notice: Subject to any disclaimer, the term of this patent is extended or adjusted under 35 U.S.C. 154(b) by 136 days.

(21) Appl. No.: 13/072,427

(22) Filed: Mar. 25, 2011

(65) Prior Publication Data

US 2011/0247176 A1 Oct. 13, 2011

(30) Foreign Application Priority Data

Apr. 9, 2010 (IT) ..... BO2010A0218

(51) Int. Cl.
*E05F 1/08* (2006.01)

(52) U.S. Cl.
USPC ..... 16/287; 16/286; 16/338

(58) Field of Classification Search
USPC ..... 16/286, 287, 288, 289, 290, 291, 292, 16/319, 337, 338, 341, 65, 50, 80, 72; 49/386, 387; 126/191, 192, 194
See application file for complete search history.

(56) References Cited

U.S. PATENT DOCUMENTS

| | | | | |
|---|---|---|---|---|
| 3,187,374 | A | 6/1965 | Lundell | |
| 3,239,874 | A * | 3/1966 | Sperzel | 16/338 |
| 5,025,776 | A * | 6/1991 | Hanley et al. | 126/194 |
| 7,243,396 | B2 * | 7/2007 | Vanini | 16/286 |
| 7,275,283 | B2 * | 10/2007 | Kistner et al. | 16/286 |
| 7,676,888 | B2 * | 3/2010 | Vanini | 16/286 |
| 2009/0064458 | A1 | 3/2009 | Vanini | |

FOREIGN PATENT DOCUMENTS

| | | |
|---|---|---|
| DE | 10107138 | 8/2002 |
| EP | 1847670 | 10/2007 |
| EP | 1961901 | 8/2008 |
| EP | 2034115 | 3/2009 |

OTHER PUBLICATIONS

Italian Search Report dated Nov. 17, 2010 from corresponding foreign application.

* cited by examiner

*Primary Examiner* — Jeffrey O Brien
(74) *Attorney, Agent, or Firm* — Timothy J. Klima; Shuttleworth & Ingersoll, PLC

(57) ABSTRACT

A hinge for wings or doors, in particular for electrical household appliances, comprises a first element (2) and a second element (3) pivoted to each other and movable relative to each other in tilting fashion, a connecting lever (5) between the elements (2, 3), the lever (5) pivoting on the first element (2), the second element (3) being box-shaped and comprising inside it a spring (7) connected to the lever (5) by a drive rod (8) which can slide at least partly inside the second box-shaped element (3) itself.

11 Claims, 5 Drawing Sheets

HINGE FOR DOORS OR WINGS

This application claims priority to Italian Patent Application BO2010A000218 filed Apr. 9, 2010, the entirety of which is incorporated by reference herein.

BACKGROUND OF THE INVENTION

This invention relates to a hinge for doors or wings, in particular for connecting the door of an electrical household appliance.

More specifically, the invention relates to a hinge for electrical household appliances such as dishwashers, etc., where the appliance doors or wings are designed to support additional covering elements such as panels or the like.

This specification describes this invention with reference to a front-opening household appliance such as a dishwasher purely by way of a non-limiting example.

Hinges of this type normally consist of two separate parts kinematically linked to each other, either directly or through an interposed lever.

More specifically, the first part, which is usually box shaped, is fixed to the appliance structure on one side of its front opening, whilst the second part is fixed to an edge of the appliance door which can thus be tilt opened with respect to the front opening.

One or more elastic elements are interposed between the two hinge parts.

Basically, the purpose of the elastic elements is to at least partly balance the door, especially to prevent the door from falling when opened.

Precisely to avoid risky accelerations of the door, especially during its opening movement when the action of the user is summed to the force weight of the door itself, the prior art teaches the use, in addition to the elastic elements, of friction elements capable of providing a certain resistance to the door movement itself.

Hinges are known in the prior art which comprise friction elements which consist of two shoes mounted on respective linkages articulated to each other, and which are designed to slide on two opposite, facing walls of the box-shaped body of the hinge.

This solution, although relatively efficient, is not free of disadvantages.

A first disadvantage is due to the complexity of the linkages the shoes are mounted on, which in practical terms, translates as a high cost not only for the components themselves but also for their assembly.

Another disadvantage, connected with the position of the shoes, is the risk of the shoes themselves becoming sullied by oily grime or lubricant residues which reduce the friction they apply.

Another disadvantage inherent in the prior art hinges with friction system is linked to the impossibility of adjusting the friction action. That means doors that differ in weight even very slightly must be provided with different hinges, which in turn involves considerably high production and storage costs to meet the requirements of doors that can vary significantly in weight, for example when the doors are covered by paneling. In other words, if an electrical household appliance leaves the factory with certain hinges, it is quite possible that the hinges will not be able to guarantee correct door balancing and friction action if the user, for aesthetic purposes, chooses to have the appliance door covered with panels, which may vary considerably in weight depending on the material the panels are made of.

SUMMARY OF THE INVENTION

The aim of this invention is therefore to provide a hinge for wings or doors which is free of the above mentioned disadvantages.

Another aim of the invention is to provide a hinge for doors or wings with improved balancing and friction capabilities.

A further aim of the invention is to provide a hinge which can be used with a large number of doors of different weights without having to modify the elastic and/or friction elements for each door.

This invention accordingly provides a hinge for doors or wings comprising the features described in any of the appended claims.

BRIEF DESCRIPTION OF THE DRAWINGS

The technical features of the invention according to the aforementioned aims may be easily inferred from the contents of the present description.

Further, the advantages of the invention are apparent from the detailed description which follows, with reference to the accompanying drawings, which illustrate a preferred, non-limiting example embodiment of it and in which.

DESCRIPTION OF THE PREFERRED EMBODIMENTS

Figure 1:
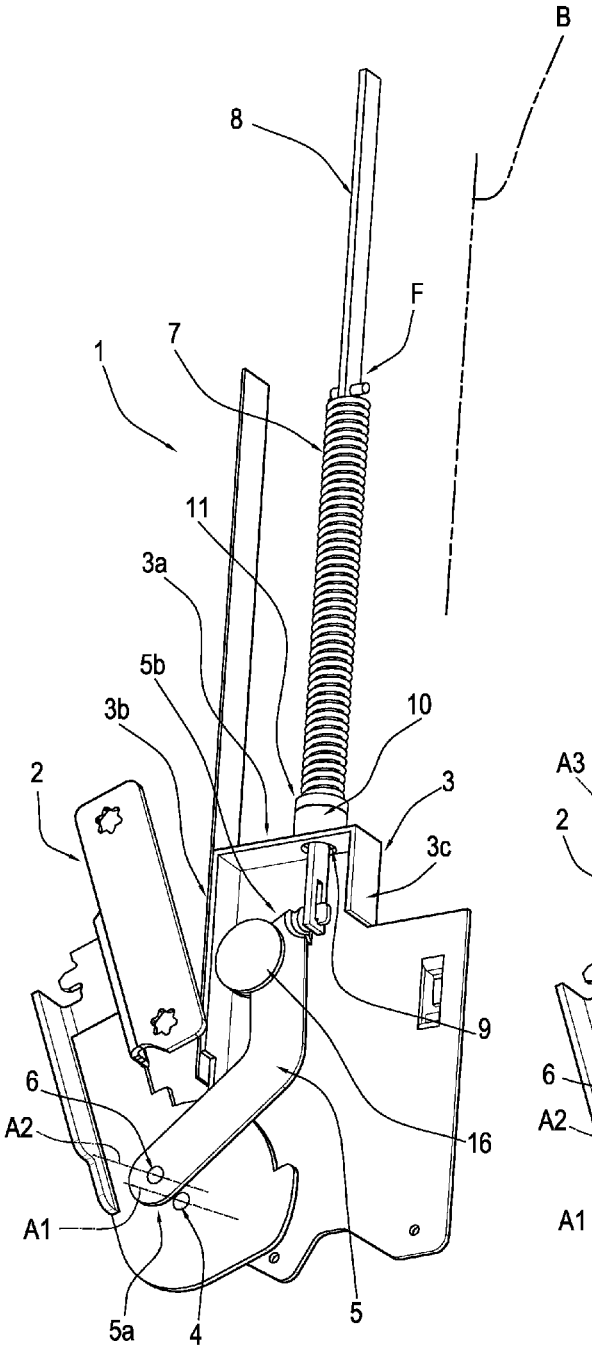
FIG. 1 is a schematic perspective view of a first preferred embodiment of a hinge according to this invention.

With reference to FIG. 1, the reference numeral 1 denotes in its entirety a first embodiment of the hinge according to this invention.

The hinge, paired with another one, is designed to be mounted, for example on an electrical household appliance, not illustrated, to connect the appliance's frame to the appliance's wing or door in such a way that the latter is movable relative to the frame between a closed position and an open position.

Figure 2:
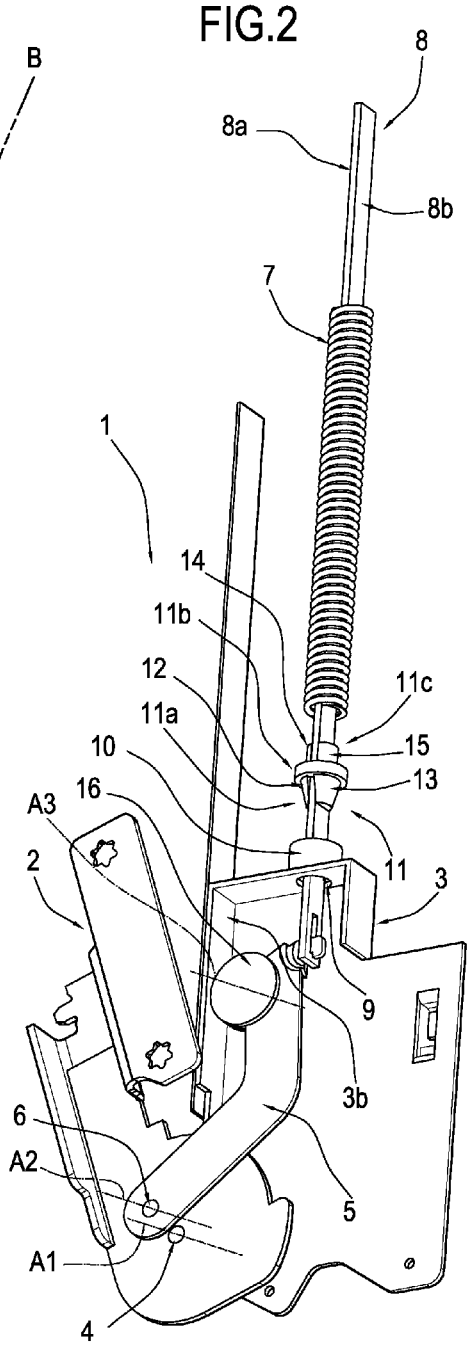
FIG. 2 is a schematic perspective view of the hinge of FIG. 1 with some parts disassembled.
Figure 3:
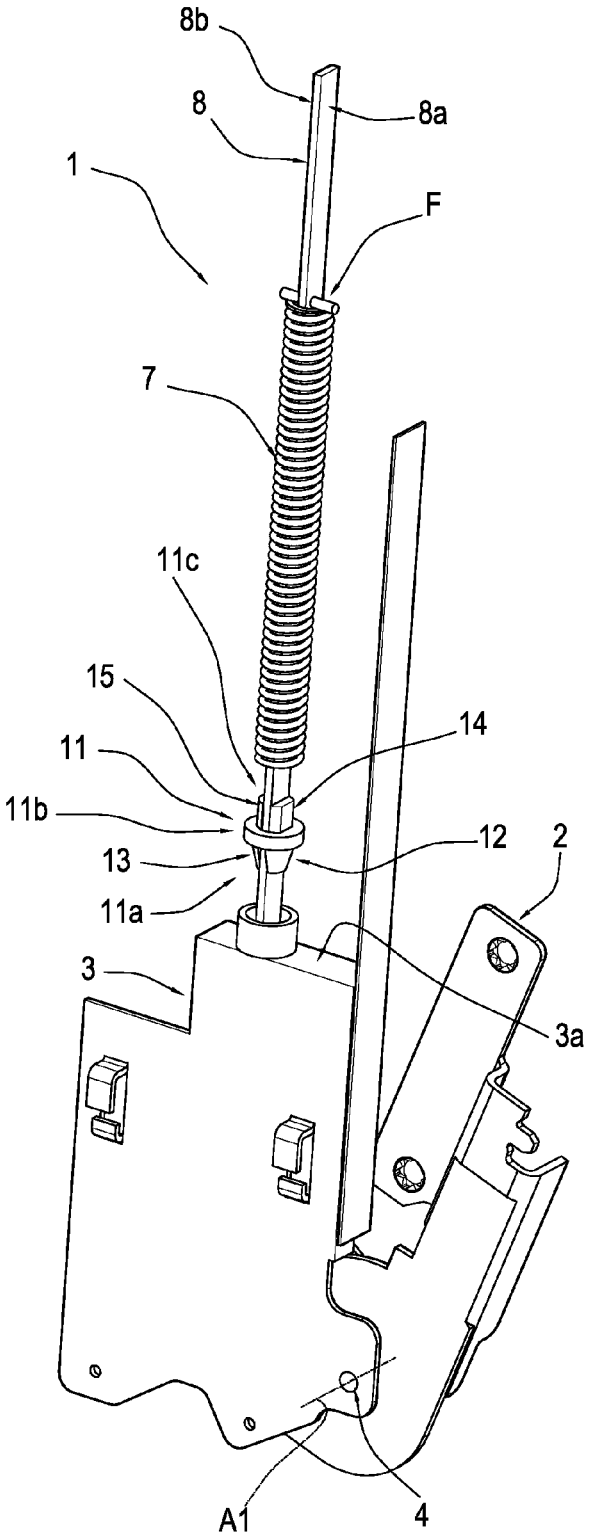
FIG. 3 shows the hinge of FIG. 2 in a view from a different angle.

With reference to FIGS. 1 to 3, the hinge 1 comprises a first element 2 adapted for fixing to the aforesaid, not illustrated door of the electrical household appliance, and a second element 3, of a box-shaped type, adapted for fixing to the aforesaid, not illustrated frame of the electrical household appliance.

The first element 2 is pivoted to the second element 3 by a pin 4 to allow reciprocal rotation of the elements 2, 3 about a respective axis of rotation A1.

The axis of rotation A1 defines the axis of rotation of the aforesaid door, not illustrated, relative to the aforesaid frame, also not illustrated.

The first and second elements 2 and 3 are kinematically connected to each other by a connecting lever 5.

At a first end of it 5*a*, the connecting lever 5 is pivoted to the first element 2 by a pin 6 in such a way as to rotate at least partly relative to the first element 2 itself about a respective axis A2.

As illustrated in the drawings, the second, box-shaped element 3 extends longitudinally along a respective axis B which is also the principal direction of extension of the second element 3.

The hinge 1 also comprises a helical spring 7 and a drive rod 8 of the spring 7, both supported by the second, box-shaped element 3.

The drive rod 8 is hooked at the bottom of it to the lever 5 at a second end of it 5*b*, opposite the first end 5*a*.

The drive rod 8 of the spring 7 is advantageously positioned inside the spring 7 itself and is connected to the top thereof, for example by a stop element F in such a way as to compress it, as described in more detail below.

In other words, the drive rod 8 has an upper end that is longitudinally opposite the end that is hooked to the lever 5, the upper end being designed to engage an upper end coil of the spring 7 in such a way as to compress the spring 7.

The spring 7 and the rod 8 extend principally along the aforesaid axis of extension B of the second element 3.

The spring 7 constitutes respective elastic means for the hinge 1.

The second, box-shaped element 3 has a set of perimeter walls, including an upper wall 3*a* and two side walls 3*b*, 3*c*, respectively front and rear.

On the upper perimeter wall 3*a*, is formed a hole 9 for the passage of the drive rod 8.

At the hole 9, and coaxial with it, there is a hollow cylinder 10 for housing a tapered friction element 11.

The friction element 11, better visible in FIG. 2 where it is illustrated outside the cylinder 10 that normally houses it during operation of the hinge 1, comprises a tapered bottom portion 11*a*, a central collar 11*b* and a cylindrical upper portion 11*c*.

The tapered bottom portion 11*a* is divided into two lateral fingernail-shaped protrusions 12, 13 adapted to superficially engage, and apply a frictional action on, the two opposite faces 8*a*, 8*b* of the rod 8.

The collar 11*b* is adapted, at the bottom of it, to come into abutment with the cylinder 10 and, at the top of it, to constitute a stop for the lower end coil of the spring 7.

The upper portion 11*c* is also divided into two parts 14, 15, each designed to face a respective face 8*a*, 8*b* of the drive rod 8.

With reference in particular to FIGS. 1 and 2, the hinge 1 comprises a roller 16, operatively interposed between the lever 5 and the second, box-shaped element 3, supported by the lever 5 itself, and adapted to rollably engage with a front side wall 3*b* of the second, box-shaped element 3.

The roller 16 has a respective axis of rotation A3, integral with the lever 5.

Advantageously, but not necessarily, the roller 16 is composed of two circular portions joined by a central hub.

During rotation, the central hub is held within a semicircular cavity 5*a* formed on the lever 5.

The embodiment of the hinge 1 illustrated in FIGS. 4 to 7 is labeled 1' and basically differs from the hinge described above with reference to FIGS. 1 to 3, solely in that the second, box-shaped element 3 has a projection 30 at the top of the upper wall 3*a*.

The projection 30, also box-shaped, houses inside it an adjustable friction element 31.

The adjustable friction element 31 comprises a first and a second plug 32, 33 made of a material with a high friction coefficient, located in such a way that each engages a respective face 8*a*, 8*b* of the drive rod 8.

The second plug 33 is advantageously fixed.

The element 31 also comprises a plate 34 fixed at longitudinal ends of it to the projection 30, and an adjustment screw 35 designed to be screwably engaged in a respective threaded hole formed on the plate 34.

In other embodiments, which are not illustrated, the plate 34 may be substituted with threading for engaging the screw 35 formed in the structure of the projection 30 itself.

The adjustment screw 35 constitutes for the hinge 1', means for modifying the position of the first plug 32 relative to the drive rod 8.

In use, screwing in the screw 35 pushes the first plug 32 against the face 8*a* of the rod 8, thereby increasing the frictional force which opposes the sliding of the two parts relative to each other. That in turn increases the frictional action opposing the opening/closing movement of the hinge 1'. Unscrewing the screw 35, on the other hand, reduces the frictional force and, hence, reduces the frictional action opposing the opening/closing movement of the hinge 1'.

Figure 5:
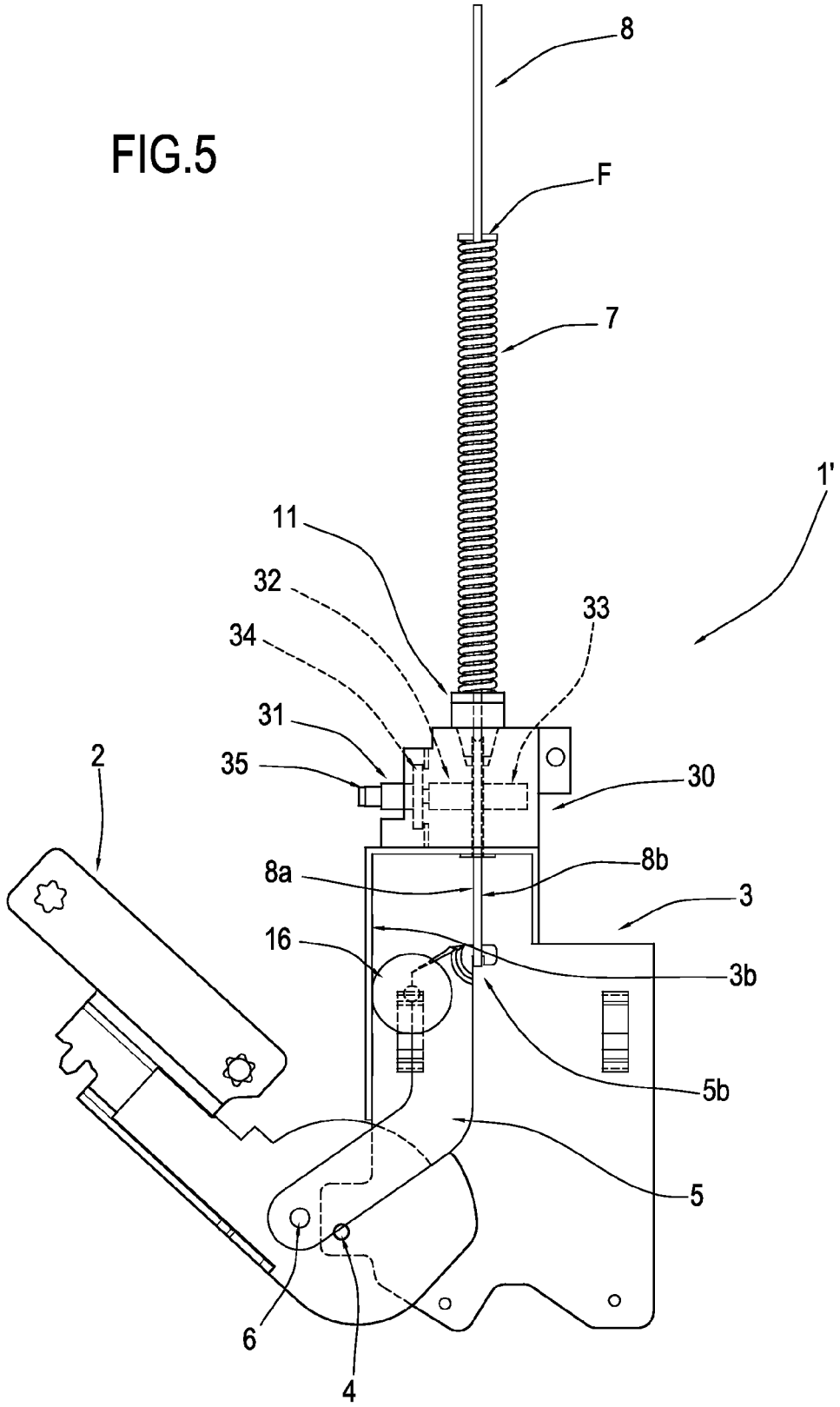
FIGS. 5 and 6 are schematic perspectives views of the hinge of FIG. 4 in two different operating configurations.

As illustrated in FIG. 5, the adjustment screw 35 is accessible from the outside of the second, box shaped element 3 so it can be easily screwed and unscrewed even after installation on the respective electrical household appliance. In other words, the screw 35, once the hinge 1' has been installed on an electrical household appliance, remains accessible to allow the frictional action to be adjusted even when the electrical household appliance itself is fully assembled, for example after it has been used for a certain period or after a covering panel has been fitted to the door of the finished appliance.

With reference to both the embodiments 1 and 1' of the hinge according to the invention, the aforesaid tapered friction element 11 and adjustable friction element 31 constitute, for the hinges 1, 1', friction means adapted to operate on the rod 8 to slow its sliding relative to the second, box-shaped element 3.

Again with reference to both the embodiments 1 and 1' of the hinge according to the invention, the roller 16 constitutes, for the hinges 1, 1', guide means for guiding the movement of the drive rod 8 along the direction of its axis of longitudinal extension.

Figure 4:
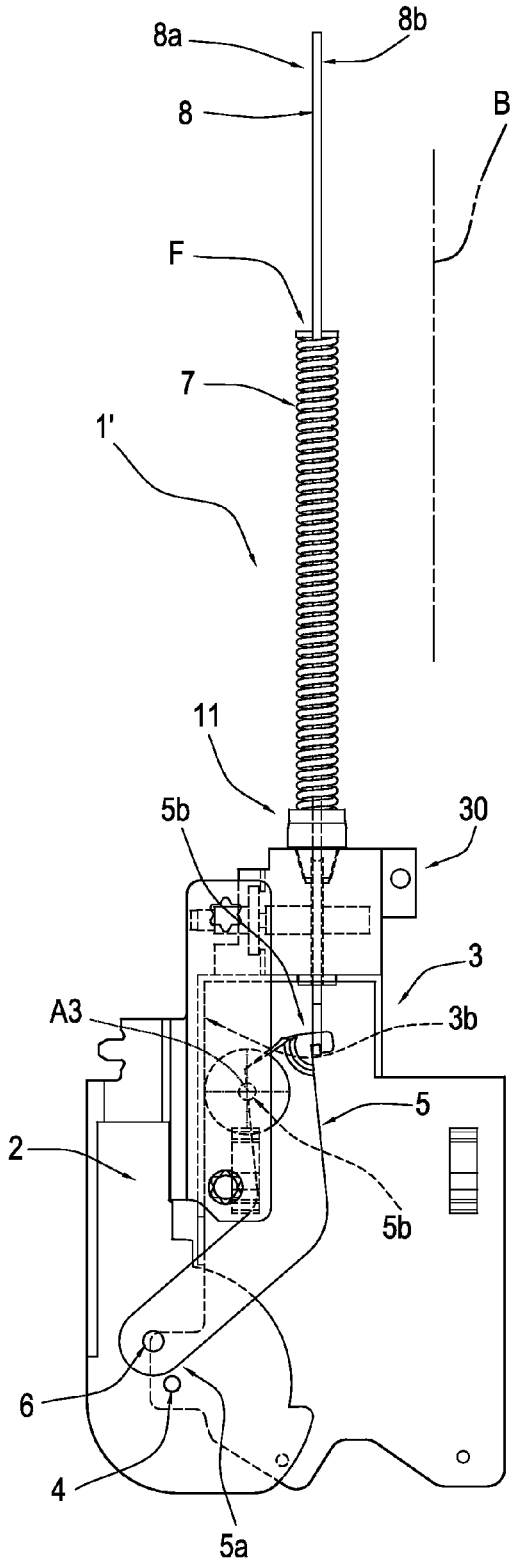
FIG. 4 is a schematic side elevation view, with some parts transparent in order to better illustrate others, of another embodiment of the hinge of the preceding figures.
Figure 6:
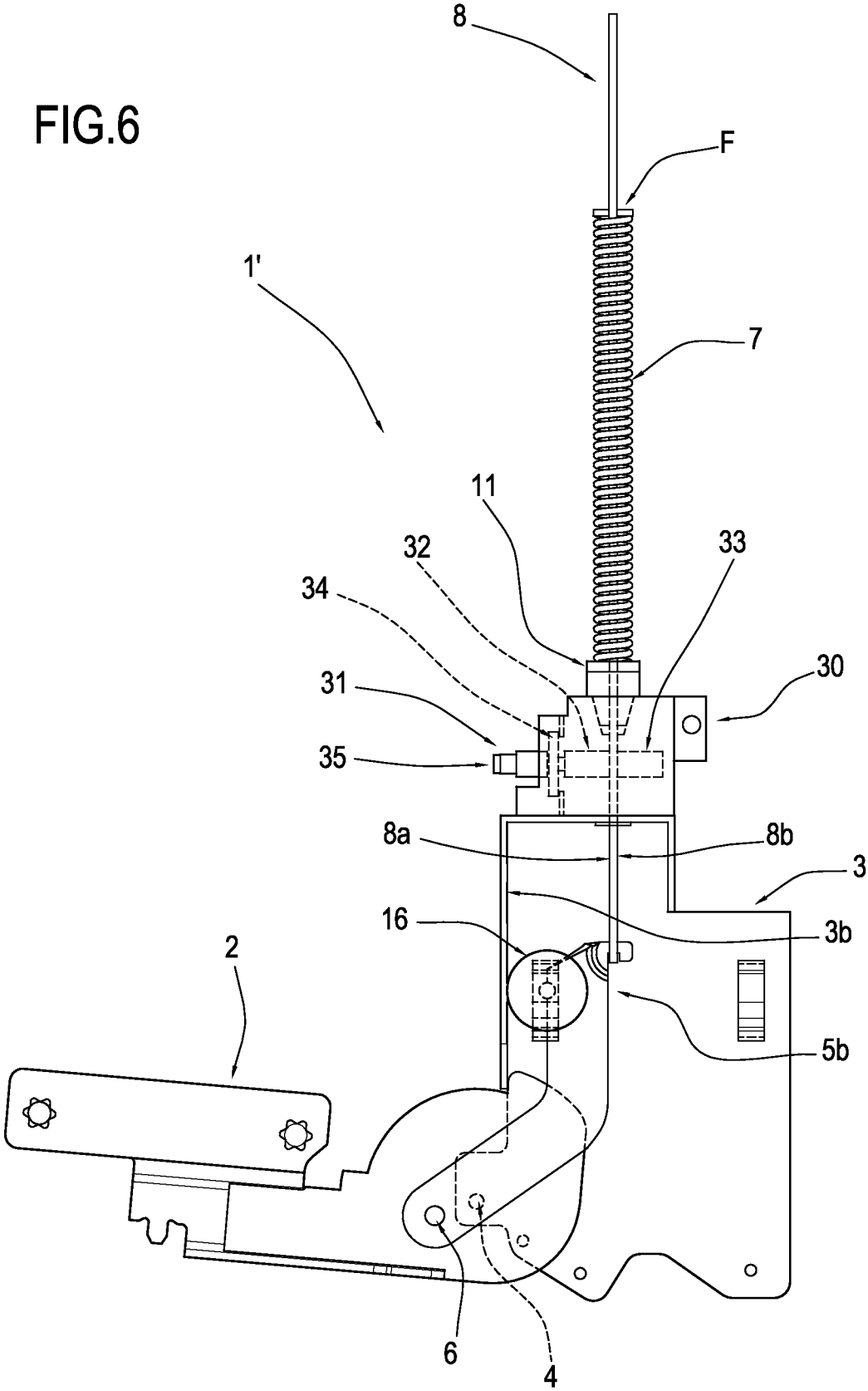
Figure 7:
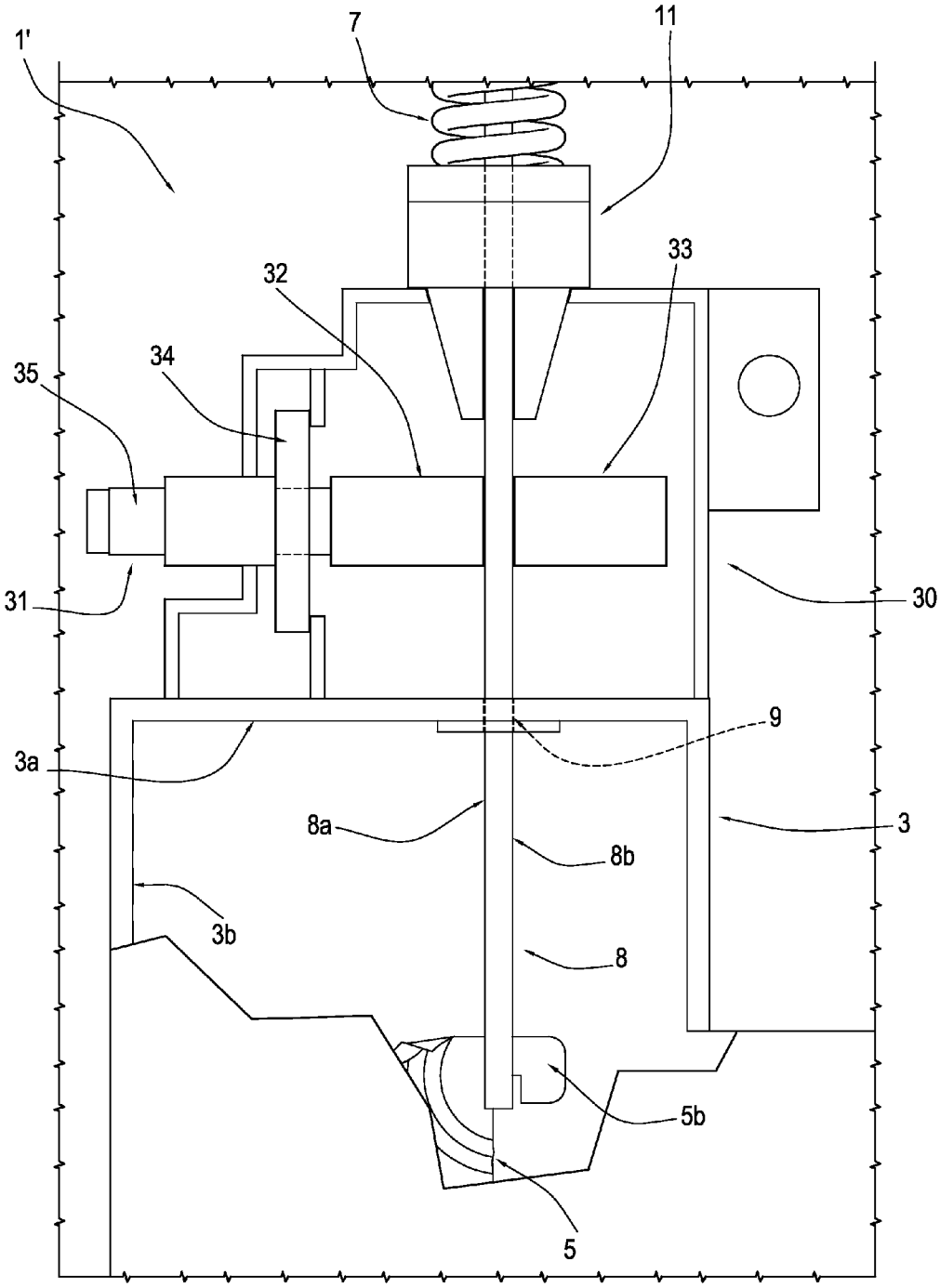
FIG. 7 is a schematic, scaled-up side elevation view, with some parts cut away in order to better illustrate others, of a detail of the hinge of FIGS. 4 to 6.

More in detail, FIGS. 4 to 6 show in sequence different operating configurations of the hinge 1', namely, a closed configuration in FIG. 4, a half open configuration in FIG. 5 and a substantially open position in FIG. 6.

During the passage from the closed configuration of FIG. 4 to the open configuration of FIG. 6, the spring 7 is compressed and loaded as a result of the pulling action applied by the rod 8 which is in turn pulled by the lever 5. In effect, the lever 5 applies a pulling action as a result of the rotation of the first element 2 relative to the second, box-shaped element 3 about the axis A1. The lever 5, in pulling the rod 8, slides inside and relative to the second, box-shaped element 3.

During its movement relative to the second, box-shaped element 3, the upper end 5*b* of the lever 5 remains substantially equidistant from the wall 3*b* of the second element 3; that guarantees that during its sliding relative to the second, box-shaped element 3, the drive rod 8 remains parallel to itself and is translated along the direction B.

The fact that the rod 8 is translated along the direction B, that is to say, without making an angle with that direction, means that the frictional action applied to it by the friction means is constant and regular.

In other words, thanks to the presence of the roller 16, the rod 8 remains with its faces 8*a*, 8*b* parallel to the friction surfaces of the friction means, thereby guaranteeing a regular frictional action without jamming. Jamming might also occur if the rod 8 moved at an angle in such a way as, for example, to strike one of the fingernail-shaped protrusions 12, 13 on the element 11.

With reference to what has already been stated above in connection with the adjustable friction element 31, attention is again drawn to the fact that the two plugs 32, 33 operate on respective faces 8*a*, 8*b* of the drive rod 8 of spring 7, the plug 33 being fixed, while the plug 32 is adjustable and able to be translated longitudinally, that is to say, towards/away from the rod 8 using the adjustment screw 35.

Basically, the screw 35, by being screwed or unscrewed, modifies the position of the plug 32. The latter thus modifies the contact force it exerts on the drive rod 8, thereby modifying the amount of frictional action it applies to the rod 8.

Experimental tests have shown that even the smallest variations in turning the screw 35, and hence in positioning the plug 32, cause appreciable changes to the frictional action on the drive rod 8 of the spring 7.

The advantage is that the frictional action on the hinge can be easily and effectively modified, even according to the weight of the door the hinge is mounted on, by a simple adjustment using a screw which is located on the edge of the side wall of the electrical household appliance and which is therefore easy to access.

As pointed out above, another essential aspect of this invention is the presence of the roller 16 which is supported by the lever 5 and which advantageously allows the drive rod 8 to be held in a straight line, keeping it on the same axis so as not to upset the setting of the frictional action to be applied. Thus, since both sides of the rod 8 are operated on by the friction means, it is very important to keep the rod on the same axis as it moves.

If it were to move out of axis, its frictional action would easily be altered: in effect, the friction applied to one face of the rod 8 would increase and that on the other face would decrease.

In this regard, the roller 16 rolls on the side wall 3*b* of the box-shaped element 3 so as to keep the linkage point on the drive rod 8 at a constant distance from side wall 3*b* itself. Otherwise, when opened, the hinge would cause the drive rod 8 to move closer to the wall 3*b* because the force applied by the lever 5 would also have a component perpendicular to the side wall 3*b* of the second, box-shaped element 3. The roller 16 advantageously allows this component of the force to be compensated by causing the pulling action of the lever 5 on the drive rod 8 to remain parallel to the axis of the rod 8.

The invention described above is susceptible of industrial application and may be modified and adapted in several ways without thereby departing from the scope of the inventive concept. Moreover, all the details of the invention may be substituted by technically equivalent elements.

What is claimed is:

1. A hinge for a door of an electrical household appliance, comprising:

a first element and a second element pivoted to each other and movable relative to each other in tilting fashion, a connecting lever between the first and the second element; the connecting lever pivoting on the first element; one of the first and second elements being fixable to a frame and the other of the first and second elements being fixable to the door, for moving the door relative to the frame between a closed position and an open position, the second element being box-shaped and comprising an elastic mechanism connected to the connecting lever by a drive rod which slides at least partly inside the second box-shaped element, a friction mechanism acting on the rod to slow the sliding movement relative to the second box-shaped element, and a guide mechanism guiding movement of the drive rod along an axis of longitudinal extension of the guide rod, the friction mechanism comprising an adjustable friction element operating on at least one face of the drive rod and adjustable to change a friction force applied on the drive rod independently of an elastic force applied to the connecting lever by the elastic mechanism.

2. The hinge according to claim 1, wherein the guide mechanism comprises a roller rollably engaging a wall of the second box-shaped element.

3. The hinge according to claim 2, wherein the roller is interposed between the connecting lever and the second box-shaped element.

4. The hinge according to claim 3, wherein the roller has an axis of rotation which is fixed relative to the connecting lever.

5. The hinge according to claim 4, wherein the roller is supported by the connecting lever.

6. The hinge according to claim 1, wherein the friction mechanism comprises a tapered friction element supported by the second box-shaped element, the drive rod being slidably inserted in the tapered friction element, the tapered friction element engaging the drive rod on two opposite faces of the drive rod.

7. The hinge according to claim 1, wherein the adjustable friction element comprises a plug made of a material with a high friction coefficient and a positioning mechanism for modifying the position of the plug relative to the drive rod.

8. The hinge according to claim 7, wherein the positioning mechanism comprises an adjustment screw.

9. The hinge according to claim 8, wherein the adjustment screw is accessible from outside of the second, box-shaped element for adjustment.

10. A hinge for a door of an electrical household appliance, comprising:

a first element and a second element pivoted to each other and movable relative to each other in tilting fashion, a connecting lever between the first and the second element; the connecting lever pivoting on the first element; one of the first and second elements being fixable to a frame and the other of the first and second elements being fixable to the door, for moving the door relative to the frame between a closed position and an open position, the second element being box-shaped and comprising an elastic mechanism connected to the connecting lever by a drive rod which slides at least partly inside the second box-shaped element, a friction mechanism acting on the rod to slow the sliding movement relative to the second box-shaped element, and a guide mechanism guiding movement of the drive rod along an axis of longitudinal extension of the guide rod, wherein the drive rod comprises a first face and a second face opposite one another; the friction mechanism comprises a first plug and a second plug made of a material with a high coefficient of friction; the first plug and the second plug frictionally engage the first face and the second face respectively; the first plug is adjustable in a direction perpendicular to a longitudinal direction of the drive rod; the friction mechanism further comprises an adjustment screw for modifying the position of the first plug relative to the drive rod; the adjustment screw extends coaxial to the first plug in the direction perpendicular to a longitudinal direction of the drive rod; the adjustment screw is accessible from outside of the second, box-shaped element for increasing or decreasing the friction on the drive rod.

11. A hinge for a door of an electrical household appliance, comprising:

a first element and a second element pivoted to each other and movable relative to each other in tilting fashion, a connecting lever between the first and the second element; the connecting lever pivoting on the first element; one of the first and second elements being fixable to a frame and the other of the first and second elements being fixable to the door, for moving the door relative to the frame between a closed position and an open position, the second element being box-shaped and comprising an elastic mechanism connected to the connecting lever by a drive rod which slides at least partly inside the second box-shaped element, a friction mechanism acting on the rod to slow the sliding movement relative to the second box-shaped element, and a guide mechanism guiding movement of the drive rod along an axis of longitudinal extension of the guide rod, wherein the guide mechanism comprises a roller rollably engaging a side wall of the second box-shaped element, an axis of the roller maintained at a fixed distance from the side wall throughout an entire range of the connecting lever between the closed position and the open position;

wherein the roller is interposed between the connecting lever and the second box-shaped element;

wherein the roller has an axis of rotation which is fixed relative to the connecting lever;

wherein the roller is supported by the connecting lever;

wherein the friction mechanism comprises an adjustable friction element including a plug made of a material with a high friction coefficient and a positioning mechanism for modifying a position of the plug relative to the drive rod;

wherein the positioning mechanism comprises an adjustment screw;

wherein the adjustment screw is accessible from outside of the second box-shaped element for adjustment;

wherein the friction mechanism also comprises a tapered friction element supported by the second box-shaped element, the drive rod being slidably inserted in the tapered friction element, the tapered friction element engaging the drive rod on two opposite faces of the drive rod.

* * * * *